United States Patent [19]

Mallek et al.

[11] 4,156,394

[45] May 29, 1979

[54] METHOD AND APPARATUS FOR THERMALLY ECONOMICAL INCINERATION OF WASTE

[75] Inventors: Heinz Mallek, Linnich-Tetz; Dieter Kuhnert, Sinsheim; Friedrich Scholz, Mühlacker, all of Fed. Rep. of Germany

[73] Assignees: Kernforschungs Anlage Jülich GmbH, Jülich; Kraftanlagen Aktiengesellschaft, Heidelberg, both of Fed. Rep. of Germany

[21] Appl. No.: 855,382

[22] Filed: Nov. 28, 1977

[30] Foreign Application Priority Data

Nov. 29, 1976 [DE] Fed. Rep. of Germany ..... 2654041

[51] Int. Cl.[2] ..... F23G 5/00; F23L 17/00

[52] U.S. Cl. ..... 110/346; 110/208; 110/210; 110/248; 110/300

[58] Field of Search ..... 110/216, 224, 248, 228, 110/298-300, 346, 268, 327, 328, 212, 227, 208, 210, 214, 259

[56] References Cited

U.S. PATENT DOCUMENTS

| | | | |
|---|---|---|---|
| 1,178,273 | 4/1916 | Simmons | 110/300 |
| 3,485,190 | 12/1969 | Pelletier | 110/210 |
| 3,547,055 | 12/1970 | Zanft | 110/216 |
| 3,641,952 | 2/1972 | Wotschke | 110/212 |
| 3,780,674 | 12/1973 | Lin | 110/212 |
| 3,807,322 | 4/1974 | Lin et al. | 110/212 |
| 3,818,847 | 6/1974 | Konrad | 110/227 |
| 3,823,677 | 7/1974 | Polsak | 110/248 |
| 4,048,927 | 9/1977 | Augustin et al. | 110/208 |

*Primary Examiner*—Henry C. Yuen

*Attorney, Agent, or Firm*—Frishauf, Holtz, Goodman & Woodward

[57] ABSTRACT

Ducts for carrying off hot gas given off from the combustion chamber of an incinerator are built into the outer walls of a pyrolysis chamber located above the combustion chamber. The pyrolysis chamber has cross-sectional dimensions that are small enough to assure that heat from the gas ducts in walls completely penetrate the fill of waste in the pyrolysis chamber. Sluice gates are provided between the pyrolysis chamber and the combustion chamber on which the fill of the pyrolysis chamber rests when the gates are quiescent. The gates are moved to allow fragments of the pyrolysis products to drop into the combustion chamber or to turn over material resting on the gates.

7 Claims, 2 Drawing Figures

METHOD AND APPARATUS FOR THERMALLY ECONOMICAL INCINERATION OF WASTE

Figure 2:
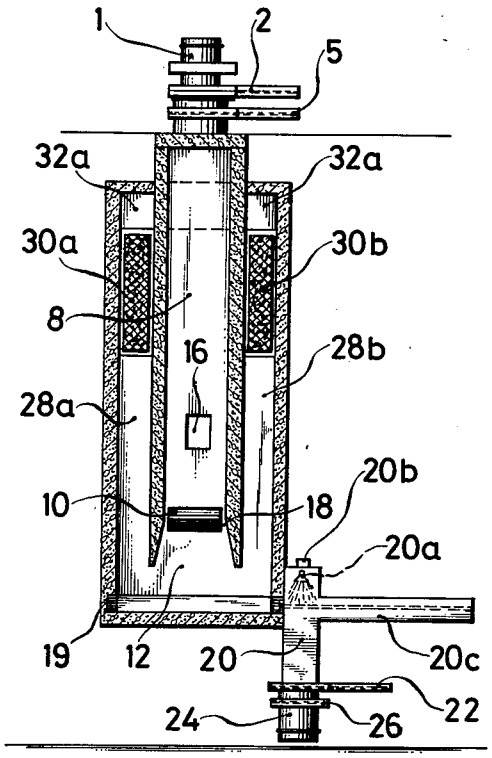

Cross reference to copending application on related subject matter: U.S. patent application Ser. No. 816,887, filed July 18, 1977, Mallek, Kuhnert, and Scholz.

The present invention concerns a method of incineration of solid waste with or without an admixture of liquid waste, and also a furnace for the purpose. The furnace of the present invention comprises two chambers, one vertically above the other. A pyrolysis chamber is located contiguously above a combustion chamber.

Another installation for the combustion of solid waste with an upper pyrolysis chamber and a contiguously located lower combustion chamber is already known. The upper pyrolysis chamber thereof, with its almost constant cross section, leads directly to the lower combustion chamber. An annular furnace chamber surrounds grate surfaces inclined against the vertical. The solids sliding down over the grate are seized by the burner flames, burnt out and melted. The grate is designed as the upper end cover of a slag chamber. The molten slag produced in the furnace chamber from residues of the pyrolysis process, is conveyed to the slag chamber and cooled at its bottom by means of a water seal. Part of the waste gases from the combustion chamber are piped upwards for heat recovery, in countercurrent to the waste material, through the gasification, degassing and finally drying sections of the pyrolysis chamber. The gases developed in the pyrolysis chamber leave this chamber at its top and are chilled outside the installation. Corrosive agents are separated out and, these gases are thereafter piped again both into the drying section of the pyrolysis chamber and, as additional fuel, into the combustion chamber.

As already mentioned, the gases from the pyrolysis process which leave the pyrolysis chamber at its top are chilled. Liquid constituents are separated in a separator. Prior to being reused as fuel gas, the noncondensable constituents of the gases from the pyrolysis process are led in countercurrent to the hot unpurified pyrolysis gases and, thus, serve cooling purposes. The waste gases from the combustion chamber which are not led into the pyrolysis chamber, give off their waste heat outside the installation to the combustion air piped to the gasification section and supplied below the grate.

Prior to disposal of this waste gas flow through the stack, the waste heat from the flue gases is utilized for external heat consuming devices and dust particles are eliminated by means of filters of conventional construction (British Pat. No. 1 365 125).

With the installation described above to treat waste of the most diverse kinds can be treated and converted into a molten slag.

The present invention is based on the following consideration. When, for the purpose of direct heat exchange, waste and gases are led in countercurrent through the pyrolysis chamber, partial or complete utilization of the pyrolysis gases for the system is only possible after these gases have passed through external heat exchangers and purification installations. This principle, however, requires very intricate and expensive installations.

It is an object of the present invention to accomplish a pyrolysis and combustion operation and to design the pertinent installation in such a way that, even with discontinuous feeding of the installation, waste material with different combustibility properties can economically be pyrolysed and subsequently burnt without requiring intricate installations therefor. The present invention also has the object of assuring that even in case of waste material with low calorific power, the required temperatures will be permanently maintained and that an extension of the installation required to meet growing demand can easily be effected without the reliability of the pyrolysis and combustion process being affected.

To meet the above mentioned requirements, the installation for the combustion of waste is, in accordance with the present invention, characterized by the following. The waste gas ducts of the combustion chamber partially or completely cover the outer walls of the pyrolysis chamber in such a way that the covered wall surfaces of the pyrolysis chamber serve at the same time as inner walls of the gas discharge duct and/or ducts. Slenderness of the pyrolysis chamber is engineered in such a way as to ensure that during the running-through of the waste, the heat from the waste gas duct completely penetrates the fill to its core. One or more sluice elements are arranged between pyrolysis chamber and combustion chamber. These elements have upper sides that seal the bottom of the pyrolysis chamber. The sluice elements are supported on a shaft or axle. From the opening of the sluice elements a passage of variable width results through which solid and gaseous products from the pyrolysis process are discharged from the pyrolysis chamber into the combustion chamber. The combustion air supply lines enter the combustion chamber below the sluice elements.

With the development of this basic principle, a combustion installation is designed in such a way that one of the inside dimensions of the cross section of the pyrolysis chamber is not more than 1000 mm and that waste gas ducts coming from the combustion chamber—which is contiguously located with the pyrolysis chamber—, run at least along those walls of the pyrolysis chamber which bound this inside dimension.

A preferable design of the pyrolysis chamber uses walls which are arranged at right angles to each other; the chamber width is 300 to 1000 mm, and the ratio of chamber width to chamber cross-section length is 1:1 to 1:5.

An advantage of this design is that the waste gas ducts of the combustion chamber can run along one pair of opposed walls of the pyrolysis chamber, whereas near or on the other pair of opposed walls support installations, actuation appliances or drive units for the movable sluice elements can be arranged.

By the selected shape and dimensioning of the chamber cross section, large wall surfaces can be used for heat transfer from the combustion gases to the solid waste and short paths are made available for heat conduction from the chamber walls to the center of the fill. Thus, heat from the exothermic combustion processes in the combustion chamber is led back into the pyrolysis chamber and is reused for the endothermic pyrolysis processes. A prerequisite for the work cycles is a mean minimum calorific value of the solid waste.

The calorific value required can easily be achieved—even in case of waste with low calorific value—, by adding waste of high calorific value. Auxiliary firing by means of fuels with high calorific value is therefore not necessary.

In accordance with the present invention, an advantage of the installation is that the design of the sluice element/elements allows their being connected to the combustion air supply lines in such a way that combustion air flows through them and enters the combustion chamber via openings provided at the bottom of these sluice elements. Another advantage is that the sluice elements are at the same time cooled by the combustion air.

Air supply of the lowest part of the pyrolysis chamber is ensured by supply lines entering this chamber above the sluice elements.

In case of increasing demands, an especially space-saving design possibility that is reliable with regard to operating efficiency is to arrange a number of pyrolysis chambers closely side by side and to provide a common waste gas take-off duct between each two neighbouring chambers for leading of gas from a combustion chamber below.

For starting up the combustion installation, burners are provided which are arranged in the flow direction before and/or after the sluice elements.

For protection and for easy accessibility these burners are installed in the top ends of the respective burner shafts, arranged on opposed chamber walls (in case of an rectangular chamber cross section, on the narrow sides):

In order to assure that the necessary combustion temperatures should be achieved even in case of waste not having the minimum calorific value, auxiliary burners are provided. Like the start-up burners of the pyrolysis chamber, the auxiliary burners are arranged below the sluice elements in the walls of the lower combustion chamber.

In another specific embodiment of the present invention the central axis of the ash removal chamber is offset from the central axis of the upper pyrolysis and the lower combustion chambers towards the incinerator installation can thus be kept low even when taking into account the required free space for handling and access.

Ash discharge can be effected in a wide variety of ways. A pusher plate or a pusher frame are to be preferred for discharging the ash heap which develops at the bottom of the lower chamber into the ash chamber. At its final position on the ash chamber side, the frame is received by an auxiliary shaft enclosing the frame on three sides as well as at its top and bottom. On the fourth side, it opens into the ash chamber. Consequently, the auxiliary shaft is subject to the same vacuum as the combustion installation connected to it.

The process according to the present invention is based on leading back heat from the waste gases of the exothermic combustion process in the combustion chamber through the walls of the preceding pyrolysis chamber and, since only short distances are involved, completely penetrating the fill and starting the endothermic drying, degassing and gasification processes; also arranging movable sluice elements in the transition cross sectional area between pyrolysis chamber and combustion chamber, from the opening of which passages of varying widths are provided through which solid and gaseous products from the pyrolysis process are discharged; supplying air above the sluice elements in order to accomplish the formation of a glowing ember bed of sufficient volume and temperature to ensure the maximum possible gasification of the waste material, whereby the solidity of the pyrolysis residues is reduced to such an extent that, with the movement of the sluice elements, the residues are crushed to particles the complete combustion of which is assured; and, finally supplying combustion air for the combustion of the pyrolysis products from below the sluice elements.

Residues from the pyrolysis process which are still combustible are completely burnt in the combustion chamber.

In case the water content of the waste is not sufficient, the waste can be moistened, either prior to being conveyed into the pyrolysis chamber, or in some section of this chamber, by water or steam. By this provision a complete water-gas reaction is assured (producer gas).

The sluice elements serve three purposes. They hold back the waste until a glowing bed of sufficient volume has developed, and then they either discharge only waste particles up to a predetermined size into the combustion chamber or else effect crushing and turning over of the waste in the pyrolysis chamber.

By the operating principle used, endothermic and exothermic processes are accomplished in separate chambers and can be regulated independently of each other. The installation as a whole readily lends itself to control by simple monitoring and control devices. By the apparatus of the present invention and the operating principle used, a heat cycle is established within the installation and waste heat is reused for the basic process itself, so that the pyrolysis and combustion steps operate almost without additional fuel.

DRAWINGS, ILLUSTRATING AN EXAMPLE

Particulars of the present invention are illustrated by a combustion installation having a rectangular chamber cross section.

Figure 1:
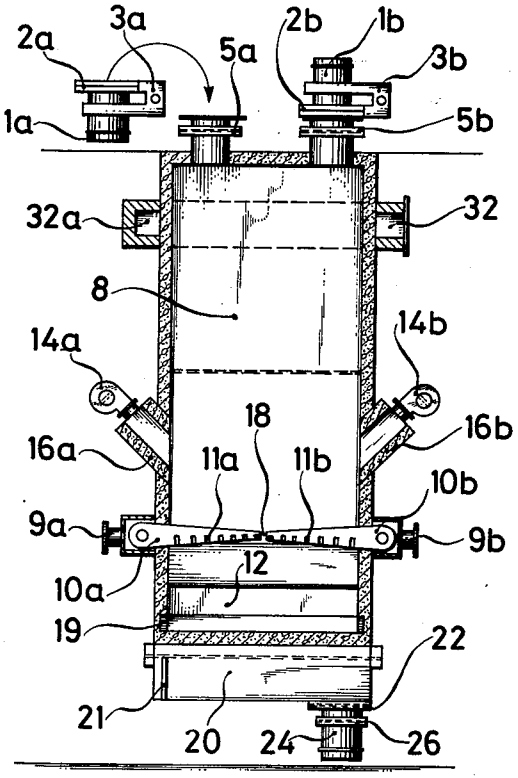

FIG. 1 is a vertical section of a combustion installation passing through the central axis and in parrallel with the chamber sides of greater width, and FIG. 2 is a vertical section of the same combustion installation parallel with the chamber sides of smaller width, likewise passing through the central axis.

As shown in FIG. 1, the waste is delivered in barrels 1*a* and 1*b*. These barrels are opened, and then 180° inverted by a tipping equipment 3*a* and 3*b* over the feed hoppers 5*a* and 5*b*. After the opening of the locks of both the tipping equipment and of the feed hoppers, the waste is discharged into the pyrolysis chamber where it settles on the sluice elements 10*a* and 10*b* arranged in the transition area to the lower combustion chamber. On opposed walls of the pyrolysis chamber 8, burners 14*a* and 14*b* are arranged at the top of burner sockets 16*a* and 16*b* in such a way that the point of intersection of the axes of the flame cones is on the central axis of the combustion installation.

After ignition of the burner flames, the heat supplied is concentrated on the center of the waste fill, and the endothermic drying, degassing and gasification processes are thereby started and, after the complete operation has been started, the burners are put out of operation. By moving the sluice elements downwards and back again into a horizontal position—either manually by an external handle (not shown) or by a drive unit—, either the gap 18 can be widened and reduced or a turning over of the contents of the pyrolysis chamber can be effected. Together with the endothermic processes, this turning over of the chamber contents causes crushing of the pyrolysis residues. Solid residues which can pass through the gap and fall into the lower combustion chamber 12 are completely burnt in the combustion chamber provided they still have some combustible constituents. Combustion air required for the combustion of the pyrolysis products which takes place in the lower combustion chamber is supplied by means of connections 9a and 9b which are provided near the swivel axes of the sluice elements. Combustion air flows through the sluice elements and enters the combustion chamber 12 through openings 11a and 11b provided at the bottom of the sluice elements. The combustion air also serves the purpose of cooling the sluice elements, thus protecting them against thermal overload which might be caused by the processes accomplished in the upper pyrolysis and the lower combustion chambers.

On the bottom of the combustion chamber there is an ash discharge frame 19 which encloses the developing ash heap. By means of this frame, the burnt ash constituents are discharged—in FIG. 1 rearwards—into the ash chamber 20. A discharge sluice 22 is connected to the bottom of the ash chamber (in FIG. 1 the sluice is provided at the right side) through which the cooled ash is discharged by means of an ash conveyor 21 into an ash drum 24 having a cover lock 26.

FIG. 2 shows the combustion installation of the present invention in a vertical section through the central axis and parallel to the chamber sides of smaller width. This figure shows the arrangement of the gas take-off ducting and the ash chamber. Gas take-off ducts 28a and 28b are provided on both sides of the pyrolysis chamber. Both sides of the walls of the pyrolysis chamber are heated by the leading off of the waste gases from the combustion chamber. Filters 30a and 30b are arranged in these gas take-off ducts through which the waste gases flow prior to entering the connecting cross ducts 32a and 32b. The ash chamber 20 located laterally offset from the installation's central axis is equipped with a spraying device 20a for accelerating the cooling of the ash. A water pipe system (not shown) is connected to the sockets 20b of the ash chamber cover. The auxiliary shaft 20c is for receiving the ash discharge frame when it has reached its final position on the ash chamber side.

By means of the combustion installation of the present invention, both, solid waste and waste having a pasty state can simultaneously be burned. Pretreatment is not necessary. If required, liquid waste can be burned too. The installation is suitable for the combustion of house waste, special wastes, radioactive waste and hospital waste which otherwise must often be incinerated in separate installations of different design and operation, with various external auxiliary devices, especially with heat exchangers and separators which are connected one beside the other.

We claim:

1. A furnace for the incineration of waste material which is at least partly solid, said furnace comprising, in combination:

a combustion chamber;

a pyrolysis chamber located vertically above said combustion chamber and having two pairs of substantially parallel lateral walls, the walls of one pair being substantially at right angles to the walls of the other pair;

at least one sluice member for controllably separating said pyrolysis chamber from said combustion chamber and controllably allowing material to pass down from said pyrolysis chamber immediately into said combustion chamber;

gas ducts for leading off upwardly the hot waste gas produced in said combustion chamber, said ducts being immediately adjacent to and running along walls of one said pair of pyrolysis chamber walls that is not exceeded in lateral dimension by the other said pair and covering at least a major part of the outer surface of said walls for heat transfer thereto, said pyrolysis chamber being vertically elongated and of cross sectional dimensions small enough to assure heat transfer penetrating to the center of the waste material therein for substantial contribution to pyrolysis thereof, and each said at least one sluice member having a closing-off upper side serving as at least part of the bottom of said pyrolysis chamber and being in each case mounted on a substantially horizontal and rotatable shaft which is connected to means for swinging said at least one sluice member by rotation of said shaft for providing an opening of variable size for discharge of pyrolysis products into said combustion chamber, the mounting, bearings and actuation or drive apparatus of the furnace, including said means for swinging said at least one sluice member being supported on or in the neighborhood of said other pair of parallel lateral walls of said pyrolysis chamber, and means for supplying combustion-supporting air to the space below said at least one sluice member.

2. A furnace for the incineration of waste as defined in claim 1 in which the interior cross-sectional dimension of said pyrolysis chamber (8) between said pair of lateral walls adjacent to said gas ducts (28a, 28b) does not exceed 1 meter.

3. A furnace as defined in claim 2 in which the cross-section of said pyrolysis chamber (8) is such that the chamber cross-sectional dimension not exceeded by the other cross-sectional dimension of the chamber is not less than 300 nor more than 1,000 mm and in which the cross-sectional dimension ratio is in the range from 1:1 to 1:5.

4. A furnace as defined in claim 1 in which said means for supplying combustion air includes a hollowed out portion of each said sluice member connected with air supply duct means (9a, 9b) and openings on the underside of each said sluice member (11a, 11b) for supplying air that flows through each said sluice member and through said openings into said combustion chamber (12).

5. A furnace as defined in claim 1 in which there are also provided air supply means above said at least one sluice member, opening into said pyrolysis chamber (8).

6. A furnace as defined in claim 1 comprising a plurality of said pyrolysis chambers laterally adjacent to each other and in which at least part of said gas ducts (28) are located between adjacent pyrolysis chambers.

7. A method of incinerating waste material which is at least partly solid comprising the steps of:

determining whether said waste material has at least a predetermined minimum moisture content and, in the event of a negative determination, moistening said waste material to assure the presence of said predetermined minimum moisture;

drying, degassing and gasifying waste material having at least said minimum moisture content in a pyrolysis chamber having at least part of its bottom constituted by at least one movable sluice member, the formation of producer gas in said pyrolysis chamber being supported by the presence of at least said minimum moisture content while producing a glowing ember bed on each said sluice member until the solidity of solid residues is sufficiently reduced to permit fragment size reductions by motion of each said sluice member;

moving each said sluice member to reduce residue fragment size and to allow fragments of that residue to fall into a combustion chamber below said pyrolysis chamber;

burning pyrolysis products in said combustion chamber;

passing hot gases produced in said combustion chamber upward along the walls of said pyrolysis chamber to provide heat for said pyrolysis chamber;

supplying combustion-supporting air to said combustion chamber, and removing ashes from said combustion chamber.

* * * * *